US006036389A

United States Patent [19]

Zima

[11] Patent Number: 6,036,389

[45] Date of Patent: Mar. 14, 2000

[54] COMBINATION BASTING BRUSH AND CONTAINER CAP

[76] Inventor: Gregory N. Zima, 25 S. Wilson, Mt. Clemens, Mich. 48043

[21] Appl. No.: 09/220,825

[22] Filed: Dec. 24, 1998

[51] Int. Cl.[7] ..... A46B 11/02

[52] U.S. Cl. ..... 401/137; 401/139; 401/183; 401/270; 401/282; 401/284

[58] Field of Search ..... 401/183, 284, 401/282, 286, 290, 270, 137, 139; 222/556

[56] References Cited

U.S. PATENT DOCUMENTS

| | | | |
|---|---|---|---|
| 1,846,711 | 2/1932 | Evensen | 401/137 |
| 1,875,426 | 9/1932 | Dillon | 401/139 X |
| 2,025,286 | 12/1935 | Hutchison et al. | 401/284 X |
| 2,064,318 | 12/1936 | Platt . | |
| 2,587,198 | 2/1952 | Mureau | 401/284 X |
| 2,669,740 | 2/1954 | Main . | |
| 3,351,415 | 11/1967 | Hoffman | 401/137 |
| 3,378,331 | 4/1968 | Beasley | 401/286 |
| 3,499,588 | 3/1970 | Bartilson et al. | 222/556 |
| 4,441,637 | 4/1984 | Libit | 222/556 |
| 4,848,946 | 7/1989 | Goncalves . | |
| 5,066,157 | 11/1991 | Liff . | |
| 5,547,303 | 8/1996 | Pyrozyk . | |
| 5,641,233 | 6/1997 | Wilson . | |

*Primary Examiner*—Steven A. Bratlie
*Attorney, Agent, or Firm*—Kenneth L Tolar

[57] ABSTRACT

A combination fluid container cap and basting brush assembly includes a cap member having a circular top wall with a continuous side wall perpendicularly depending therefrom. The cap member may be threadedly coupled with a conventional fluid container. On the top wall of the cap member is a depression having an aperture therein through which a fluid may be dispensed from the container. A lid hingedly engages the top wall of the cap member and is dimensioned to seat within the depression for covering the dispensing aperture. A brush member is removably attached to the top wall immediately adjacent the lid which may be used as a basting brush. When the lid is in an open position, it functions as a splash guard for preventing fluid from contacting the brush while being dispensed through the aperture.

7 Claims, 1 Drawing Sheet

COMBINATION BASTING BRUSH AND CONTAINER CAP

BACKGROUND OF THE INVENTION

The present invention relates to a dispensing cap for a sauce container having a basting brush conveniently secured thereto.

DESCRIPTION OF THE PRIOR ART

When cooking meats and similar food items, a user often intermittently applies marinades, sauces, and similar condiments to enhance the meat's flavor and to prevent it from drying. Once the sauce is applied, it is often desirable to evenly distribute the sauce over the exterior surface of the meat to assure that the entirety of the meat is evenly coated. Accordingly, a user must maintain a brush or similar utensil nearby. Once the brush is initially used, it must be continuously held which is inconvenient; alternatively, it must be placed on a support surface which is unsanitary. Additionally, storing and retrieving the additional utensil is burdensome and inconvenient. Although cap/brush combinations exist in the prior art, the devices are designed such that fluid is dispersed directly onto or through the brush. Accordingly, in those instances in which dispensing a fluid is desired but the brush is not required, the brush is needlessly soiled and must be cleaned prior to use.

A variety of cap structures having an integral or detachable brush exist in the prior art. For example, U.S. Pat. No. 5,547,303 issued to Pyrozyk relates to an apparatus for dispensing and applying fluid from a container. The device includes a cap covering the container having a conduit extending therethrough with a coupling member at a distal end. A brush head is attached to the coupling allowing fluid from the container to be dispensed therethrough.

U.S. Pat. No. 5,066,157 issued to Liff relates to a brush applicator adapted for use with a squeeze tube. The applicator includes an angular mounting member having an opening extending therethrough. The applicator is threadedly connected to a squeeze tube and includes a plurality of bristles at one end of the mounting member.

U.S. Pat. No. 4,848,946 issued to Goncalves relates to a dispensing container including a brush type applicator. The container includes a dispensing head having an angled injection nozzle extending therefrom. A brush head is removably securable to the injection nozzle through which a fluid is dispensed. Alternatively, the brush head may be removed and stored within a sleeve in an upright position allowing a cylindrical cap to be placed over the dispensing head.

U.S. Pat. No. 2,669,740 issued to Main relates to a closure cap and brush dispenser. The device includes threadedly connected inner and outer members one of which has a sealing ring therein. One of the connector members has a brush member extending therefrom.

U.S. Pat. No. 2,064,318 issued to Platt relates to a fountain brush comprising a combined brush and cap.

U.S. Pat. No. 5,641,233 issued to Wilson relates to a device including a brush applicator having a brush body with bristles and a cap for surrounding the dispensing opening on a container. The brush applicator threadedly engages the container, the threads forming part of a valve structure wherein tightening the threads effects a fluid seal and loosening the threads allows variable fluid flow from the container to the brush applicator.

Each of the above described brush and cap combinations has several disadvantages. With each of the conventional assemblies, the fluid is dispensed directly from the container through the brush head. Accordingly, if the brush is not needed, such as when dispensing sauce onto a plate, the brush will be needlessly soiled. Therefore, the conventional assemblies cannot be practically used as a permanent replacement bottle cap since each use will stain the brush. The present invention provides a combination cap and applicator brush assembly designed to replace the factory supplied container cap. The fluid discharge opening is selectively coverable with a pivotable lid which, when in the upright position, operates as a splash guard for the applicator brush preventing it from being needlessly stained.

SUMMARY OF THE INVENTION

The present invention relates to a combination container cap and applicator brush. The device includes a cap member having a circular top wall and a cylindrical continuous side wall perpendicularly depending therefrom. The inner surface of the side wall is preferably threaded for coupling the cap member with a threaded neck on a conventional fluid container. Removeably attached to the top wall of the cap member is an applicator brush having a substantially hyperbolic cross-sectional configuration. Also on the top wall, immediately adjacent the applicator brush, is a depression having an aperture therein that extends completely through the cap member through which a fluid is dispensed. Hingedly engaging the top wall of the cap member is a lid having a substantially identical configuration as the depression so as to be seatable therewithin. The lid may be pivoted to a horizontal position to block the fluid discharge opening. Alternatively, the lid may be pivoted to a vertical position to protect the brush from splattering fluid when dispensing a fluid through the aperture. It is therefore an object of the present invention to provide a combination basting brush and container cap that is easy to use and inexpensive to manufacture.

It is yet another object of the present invention to provide a combination basting brush and container cap that allows fluid to be dispensed therethrough without contaminating the brush.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
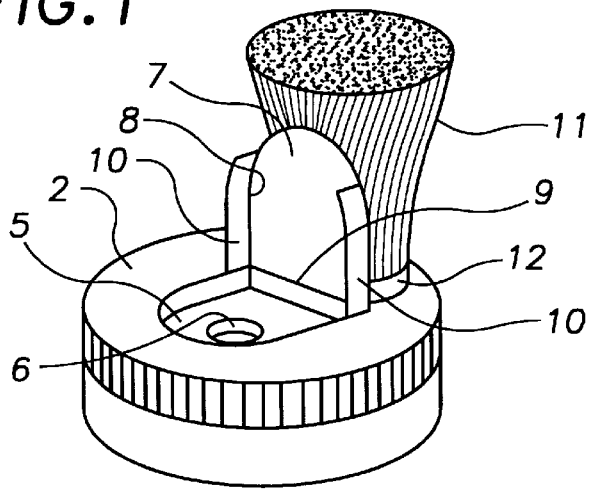
FIG. 1 is a perspective view of the inventive device.
Figure 2:
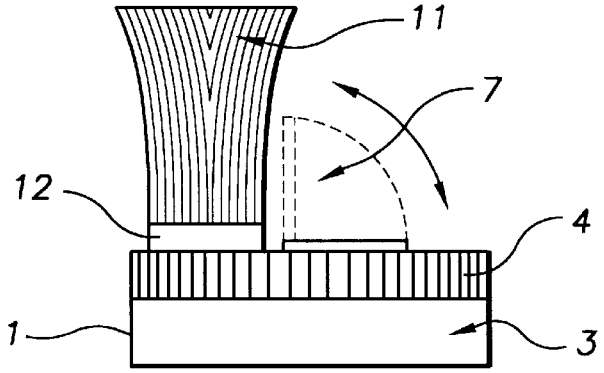
FIG. 2 is a side view of the inventive device.

Referring now to FIGS. 1 and 2, the present invention relates to a combination container cap and basting brush assembly. The device comprises a cap member 1 having a circular, planar top wall 2 with a continuous cylindrical side wall 3 perpendicularly depending from the peripheral edge thereof. A portion of the side wall may have peripheral raised ridges 4 to assist a user in grasping the cap member. On the inwardly facing side of the side wall are threads for threadedly coupling the cap member with the externally threaded neck portion of a fluid container such as a conventional barbecue sauce bottle. On the top wall of the cap member is an semi-elliptical depression 5 having an aperture 6 therein that extends completely through the cap member. The depression acts as a reservoir for fluid seeping from the aperture, preventing the fluid from running down the sides of the fluid container. The aperture provides a dispensing opening through which a fluid is dispensed from the container through the cap member.

Hingedly engaging the top wall of the cap member immediately adjacent the depression is a lid member 7 pivotable between a horizontal and a vertical position. The lid member includes a U-shaped outer edge 8 and a straight edge 9 with the straight edge hinged to the cap member. The lid has a substantially identical configuration and dimension as the depression to tightly seat therewithin. Perpendicularly depending from the U-shaped outer edge at each of two opposing portions thereof is a slightly arcuate side wall 10 to prevent fluid from seeping from the depression when the lid is closed.

Figure 3:
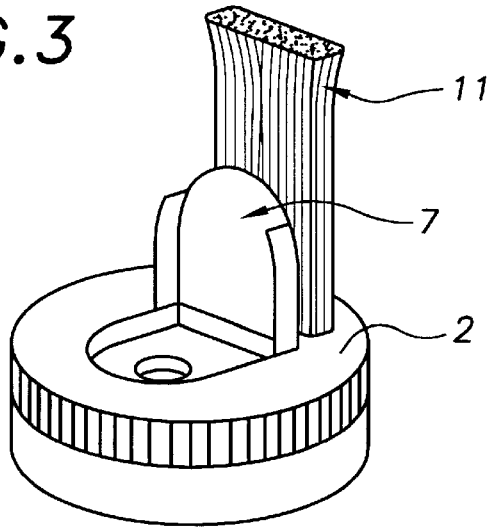
FIG. 3 depicts an alternative brush member according to the present invention.

Removeably secured to the top wall of the cap member immediately adjacent the lid is a brush member 11 having a hyperbolic vertical cross-sectional configuration. The hyperbolic configuration allows a plurality of brush bristles to be bundled at a first end to attach to a cap having a relatively small surface area. The opposing ends are spread so as to allow the brush to apply fluid to larger areas more efficiently. The brush member is secured to the top wall of the cap member using conventional means such as a cylindrical sleeve 12 secured to an end of the brush dimensioned to receive a projection on the cap member. However, as will be readily apparent to those skilled in the art, various other attachment means such as clips, snaps, etc. may also be used. In addition, the brush member may have various other configurations. For example, the brush 11 may be substantially rectangular similar to conventional basting brushes as depicted in FIG. 3.

Preferably, the above described device replaces the conventional container cap. When a user wishes to dispense a fluid from a container through the cap member, the lid is pivoted to a vertical position and the container is squeezed or inverted to dispense the fluid through the dispensing opening. The lid, when in a vertical position, will simultaneously function as a splash guard preventing any fluid from contacting the base of the brush where it will be wasted. Accordingly, if it is not desired to use the brush member, the brush will remain clean until needed. Alternatively, the brush may be simply removed if the brush is not needed.

Although a specific construction for the pivotable lid has been disclosed, other designs will suffice such as the pivotable, spout type lid found on conventional salt containers.

The various components of the above described invention are preferably constructed with plastic or a similar equivalent. However, as will be readily apparent to those skilled in the art, the size, shape and materials of construction of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A combination cap and brush assembly comprising:

a cap member having a threaded portion for threadedly engaging a threaded neck on a fluid container, said cap member having an upper surface;

a fluid conduit having an outlet, said conduit extending completely through said cap member through which fluid is dispensed from said container;

a brush member removably attached to the upper surface of said cap member;

a lid having a rear edge hingedly engaging the upper surface of said cap member and positioned between said brush member and the outlet of said conduit whereby said lid can be pivoted between a horizontal position, overlaying said conduit outlet to prevent fluid passage therethrough and a vertical position providing a vertical barrier between said brush member and said conduit outlet preventing fluid exiting said outlet from contacting said brush member.

2. A combination cap and brush assembly according to claim 1 wherein the upper surface of said cap member includes a depression having the conduit outlet disposed therein, said depression defining a reservoir for receiving fluid seeping from said conduit outlet.

3. A combination cap and brush assembly according to claim 2 wherein said lid is dimensioned and configured to seat within said depression when pivoted to said horizontal position.

4. A combination cap and brush assembly according to claim 3 wherein said lid includes a pair of opposing side walls depending from a peripheral edge thereof that provide a horizontal barrier within said depression when said lid is in said horizontal position to further retain fluid within said depression.

5. A combination cap and brush assembly according to claim 4 wherein said cap member includes a side wall having a plurality of raised ridges circumferentially disposed thereon for providing a non-slip surface when grasped by a user.

6. A combination cap and brush assembly according to claim 5 wherein said brush member has a substantially hyperbolic vertical cross sectional configuration having a first end with a predetermined cross sectional area so as to be attachable to said cap member and a second end having a larger cross sectional configuration than said first end to form a wide basting surface.

7. A combination cap and brush assembly according to claim 1 wherein said brush member is elongated and has a substantially rectangular cross-sectional configuration.

* * * * *